US009614272B2

(12) United States Patent
Wallace

(10) Patent No.: US 9,614,272 B2
(45) Date of Patent: Apr. 4, 2017

(54) AIRCRAFT ANTENNA MOUNTING SYSTEM

(71) Applicant: The Boeing Company, Chicago, IL (US)

(72) Inventor: Michael G. Wallace, Federal Way, WA (US)

(73) Assignee: THE BOEING COMPANY, Chicago, IL (US)

( * ) Notice: Subject to any disclaimer, the term of this patent is extended or adjusted under 35 U.S.C. 154(b) by 720 days.

(21) Appl. No.: 13/859,465

(22) Filed: Apr. 9, 2013

(65) Prior Publication Data

US 2015/0207214 A1 Jul. 23, 2015

(51) Int. Cl.
*H01Q 1/28* (2006.01)
*H01Q 1/12* (2006.01)
*H01Q 1/42* (2006.01)

(52) U.S. Cl.
CPC ..... *H01Q 1/28* (2013.01); *H01Q 1/12* (2013.01); *H01Q 1/42* (2013.01); *Y10T 29/49016* (2015.01)

(58) Field of Classification Search
CPC ..... H01Q 1/12; H01Q 1/28
USPC ..... 343/705
See application file for complete search history.

(56) References Cited

U.S. PATENT DOCUMENTS 5,820,077 A 10/1998 Sutliff et al.
7,274,336 B2 * 9/2007 Carson ..... H01Q 21/00 343/705
7,295,165 B2 * 11/2007 Ferguson ..... H01Q 1/286 343/705
7,786,937 B1 * 8/2010 Stierhoff ..... H01Q 1/1214 343/700 MS
7,967,253 B2 * 6/2011 Ferguson ..... B64C 1/36 244/121
2009/0034475 A1 2/2009 Runyon et al.
2010/0315301 A1 * 12/2010 Marten ..... H01Q 1/3275 343/713
2011/0279337 A1 11/2011 Corwin et al.
2011/0282521 A1 11/2011 Vlad
2012/0086613 A1 * 4/2012 Lundeen ..... H01Q 1/1214 343/705
2012/0188143 A1 7/2012 Yang et al.
2012/0212391 A1 8/2012 Dazet

OTHER PUBLICATIONS

"ThinAir Ka1000: Office-in-the-Connectivity," ThinKom Solutions, Inc., copyright 2011, 2 pages. Accessed May 8, 2013, http://thinkom.com.
Shekher et al., "FAB-T Platform Day—LAA Flight Testing," MIT Lincoln Library, Mar. 17, 2009, 1 page.
(Continued)

*Primary Examiner* — Dameon E Levi
*Assistant Examiner* — Walter Davis
(74) *Attorney, Agent, or Firm* — Yee & Associates, P.C.

(57) ABSTRACT

A method of manufacturing is provided comprising forming a mounting plate adaptable to a plurality of models of aircraft, forming an adapter plate configured for use with the mounting plate, forming a radome configured to attach to the mounting plate, configuring a shape of the adapter plate to encompass at least one footprint of at least one antenna, and providing a plurality of hole patterns through the adapter plate corresponding to known hole patterns of the at least one antenna.

20 Claims, 10 Drawing Sheets

(56) References Cited

OTHER PUBLICATIONS

Lemme, "SatCom Buyer's Guide," NBAA 65th Annual Meeting & Convention, Oct. 30, 2012, 30 pages. (p. 21).
Kirby, "JetBlue's inflight Internet provider says naysayers will be proven wrong," Apex, Nov. 19, 2012, 3 pages. Accessed May 8, 2013, http://blog.apex.aero/ife/jetblues-inflight-internet-provider-naysayers-proven-wrong/.
"Mark I Aviation Ku-Band and Ka-Band Satellite Communication System Part 1: Physical Installation and Aircraft Interfaces," ARINC Characteristic 791, Aeronautical Radio Inc, Jun. 3, 2011, 169 pages.
Extended European Search Report, dated Jul. 23, 2014, regarding Application No. EP14160605.3, 7 pages.

* cited by examiner

AIRCRAFT ANTENNA MOUNTING SYSTEM

BACKGROUND INFORMATION

1. Field

The present disclosure relates generally to aircraft and in particular to antennas for aircraft. Still more particularly, the present disclosure relates to a method and apparatus for mounting antennas to aircraft.

2. Background

Aircraft often employ antennas for various purposes. The antennas may be used to exchange communications, radar systems, or for other suitable functions for the aircraft. These antennas may include satellite communications antennas such as phased array antennas, radar antennas, and other suitable types of antennas.

These antennas are often covered by enclosures that protect the antenna. These enclosures may be weatherproof and may take the form of a radome.

A radome provides an aerodynamic fairing and enclosure for frequency band antenna assemblies in manners that may satisfy specified electrical, aerodynamic, structural, environmental, and interface requirements. A radome is transparent to the signals that may be transmitted or received by the antenna. The radome is often configured to protect the antenna from weather conditions and other environmental conditions, such as bird strikes and lightning, which may be encountered during use of the antenna on the aircraft. Further, the radome also may conceal or hide the antenna from view.

Currently, the radome and the mounting system for the antenna in an antenna system are designed for particular aircraft and a particular antenna. These designs take time and expense. Designing a new radome and mounting system for a new satellite antenna may be more expensive and may take more time than desired. For example, a new radome and mounting system for a satellite antenna may take years to design, test, and certify by relevant agencies. This type of effort and cost for antenna systems adds to the time and expense of manufacturing aircraft. Therefore, it would be desirable to have a method and apparatus that takes into account at least some of the issues discussed above, as well as other possible issues.

SUMMARY

The illustrative embodiments provide an antenna attachment apparatus comprising a radome comprising at least one layer of composite material, a mounting plate attached to the radome and an adapter plate associated with the mounting plate, the adapter plate being configured to fit a plurality of antennas.

The illustrative embodiments also provide a method of manufacturing. The method comprises forming a mounting plate adaptable to a plurality of models of aircraft, forming an adapter plate configured for use with the mounting plate, forming a radome configured to attach to the mounting plate, configuring a shape of the adapter plate to encompass at least one footprint of at least one antenna, and providing a plurality of hole patterns through the adapter plate corresponding to known hole patterns of the at least one antenna.

The illustrative embodiments also provide a system. The system comprises an aircraft comprising a fuselage configured for flight, a radome comprising at least one layer of composite material, a mounting plate attached to the radome, and an adapter plate associated with the mounting plate, the adapter plate being configured to fit a plurality of antennas.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
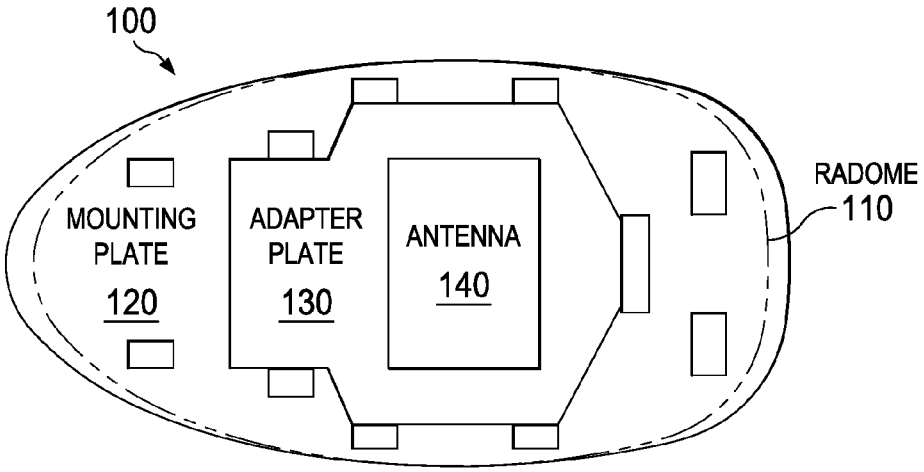
FIG. 1 is an illustration of an aircraft antenna mounting system in accordance with an illustrative embodiment.

The illustrative embodiments recognize and take into account the issues described above with respect to costs and complications associated with affixing radar antennas to aircraft. Thus the illustrative embodiments relate to systems and methods of providing an attachment apparatus for a radome that accommodates radar antennas available from various antenna providers. An aircraft manufacturer may, for example, sell a model of aircraft to a number of airlines. Each airline may have its own preference as to a particular radar antenna for that model of aircraft that it wishes to have installed on the aircraft it is purchasing. Having a single model of adapter plate designed, installed, or in parts inventory that accommodates at least several models of antennas may provide an aircraft manufacturer with cost savings, as well as manufacturing and purchasing flexibility.

The illustrative embodiments also recognize and take into account that airlines, maintenance providers, aircraft leasing companies, and others may have been previously required to completely uninstall a radome from a fuselage of an aircraft to replace an antenna. Because replacing an antenna previously required removal of radome from an aircraft fuselage and replacement of adapter plate and associated substructure, antenna replacement has traditionally been a costly and time consuming process. Such an extended process may have been costly in terms of purchasing a replacement adapter plate, employing skilled labor needed to perform associated tasks, dealing with regulatory bodies to recertify the aircraft if necessary once replacement is complete, and the opportunity costs of having a large revenue-producing asset out of service. The illustrative embodiments may allow these interested parties to reduce capital and maintenance costs and maintain aircraft in service for longer periods by alleviating the need to completely remove a radome and attachment hardware from an aircraft to replace an antenna.

The illustrative embodiments also recognize that with ongoing development of antennas that accommodate both $K_\mu$ and $K_a$ frequency bands of the microwave spectrum, a desire exists for a design of adapter plate that may accommodate antenna upgrades. As airlines increasingly transition to $K_a$ implementations to avail themselves of improved signal handling capabilities of $K_a$ band, greater flexibility in accommodating antenna models may be appropriate. Airlines and others replacing antennas to upgrade from $K_\mu$ band spectrum to $K_a$ band spectrum or handle both concurrently may appreciate the flexibility of not having to replace adapter plates and suffer the aforementioned associated costs and revenue losses of completely removing and reinstalling the radome. Additionally, a carrier may wish to deploy one or more hybrid $K_\mu/K_a$ antenna.

Design of adapter plate provided by the illustrative embodiments may be of interest to various aviation vendors including manufacturers of commercial jet aircraft, private jet aircraft, and military aircraft. The design of adapter plate may be more robust to accommodate multiple antenna types while maintaining radome attachment mounting provisions such as locations of lugs and fasteners, aft connector feed-through pocket and electromagnetic interference connection. The design of adapter plate may also provide for features including common water line attach deck, provisions for external line replaceable unit attach, and an improved upper surface design for better radio frequency performance. As used here, the water line attach deck may be an elevated and off-aircraft geometrically shaped planar feature where multiple antenna mounting systems may occur.

The adapter plate provided by illustrative embodiments may be shaped and have patterns of holes and fasteners that accommodate antennas provided by a variety of manufacturers in many form factors. The adapter plate of the illustrative embodiments may be shaped such that additional space is available to accommodate such extra components as power unit frequency modulator. The shape of the adapter plate may also allow antennas from a number of manufacturers to be installed using a single radome model.

The illustrative embodiments recognize that swept volume, which may be a cylindrical surface generated by the rotation of an antenna, may provide an approximately 0.50 inch clearance from the inside mold line in the area at or near and above a field of view of a radome. This amount of clearance may vary. Swept volume includes dynamic offset and assembly tolerance offset. Field of view is around an attach surface of the radome to adapter plate with exception of water line attach plane.

Attention is now turned to the figures. FIG. 1 is an illustration of an aircraft antenna mounting system in accordance with an illustrative embodiment. FIG. 1 depicts a system 100 including an adapter plate and radome coupled together. System 100 shown in FIG. 1 includes radome 110, mounting plate 120, and adapter plate 130. In an embodiment, adapter plate 130 and mounting plate 120 comprise separate components that are fastened or otherwise coupled together. In embodiment, adapter plate 130 and mounting plate 120 comprise a single continuous component. Radome 110 may be mounted to mounting plate 120 and mounting plate 120 may be mounted to a fuselage of an aircraft. System 100 also includes antenna 140 that may be attached to adapter plate 130.

The illustrative embodiments provide that a plurality of different models of antenna 140 sold by different manufacturers may be attached to adapter plate 130 without uninstalling radome 110 and mounting plate 120 from the fuselage of the aircraft. Mounting plate 120 may also hold a closeout fairing. As used herein the closeout fairing may be a structure between the base of radome 110 and the surface of an aircraft fuselage whose primary function is to produce a smooth outline and reduce drag.

Radome 110 may be, within one or more selected wavelength bands, an electromagnetically transparent domelike structure that houses antenna 140. However, the shape of radome 110 may be varied as desired. A function of radome 110 may be to protect antenna 140 from bird strikes as well as ravages of the environment, including wind, snow, ice, rain, salt, sand, sun, lightning, and freezing temperatures. Radome 110 may be made of at least one layer of composite material. In an embodiment, radome 110 includes several layers of epoxy foam, quartz epoxy, and an epoxy paint system. The thickness of radome 110 may vary, but in an illustrative embodiment the thickness of radome 110 may be about one-half inches.

Antenna 140 may be a radio frequency antenna attached to adapter plate 130. Antenna 140 may be contained within and housed by radome 110. Antenna 140 may be used by aircraft to which radome 110, adapter plate 130, mounting plate 120, and antenna 140 are attached to communicate with satellites, other aircraft, and ground devices regarding positioning and navigation. Antenna 140 may be mechanically actuated with a motorized pedestal and may be an elevation phased array antenna 140. Antenna 140 may transmit and receive using a plurality of frequencies. Antenna 140 may use at least one of $K_\mu$ band and $K_a$ band of microwave spectrum to exchange signals with satellites and other devices; however, other bands and combinations thereof also are contemplated.

In the past, industry standard procedures required manufacturers or aircraft installing radar antennas to maintain a variety of models of radomes and attachment and mounting hardware in a parts inventory. This condition was due to attachment and mounting hardware not being configured to accommodate more than one or a few radar antennas. Hardware on adapter plates to which radar antennas were attached and which are enclosed by radome covers have not traditionally been able to accommodate more than one or more than a small number of models of radar antennas.

Moreover, in the past, radar antennas attached directly to fuselage. Replacing antennas in the past was accompanied by increased risk of damage to fuselage.

The illustrative embodiments address this issue. Specifically, the illustrative embodiments provide adapter plate 130 containing multiple patterns of holes and multiple patterns of fasteners. This design enables attachment of different models of antenna 140 from a plurality of manufacturers of antenna 140.

Adapter plate 130 provided in the illustrative embodiments may accommodate a plurality of models of antenna 140 and may relieve aircraft manufacturers and others from a burden of maintaining a plurality of different models of attachment hardware and radome covers in their parts inventory. The availability of adapter plate 130 provided in the illustrative embodiments may also relieve airlines and others tasked with replacing antenna 140 attached to aircraft presently in service from the need to completely remove radome 110 and attachment hardware from aircraft. Removing a radome represents a potentially costly and time consuming process that the illustrative embodiments may avoid. Furthermore, the illustrative embodiments provide relief from needing to reseal around edges of the components of radome and further mitigate fraying surfaces that may result from replacing a radome.

For purposes of illustration, FIG. 1 depicts components of system 100 at an angled view, as opposed to depicting the components at a directly horizontal or directly overhead view. Radome 110 may be a domelike enclosure fully covering antenna 140 and covering most or all of mounting plate 120 which includes adapter plate 130. The portion of mounting plate 120 depicted using a dotted line in FIG. 1 is a portion of mounting plate 120 behind radome 110. While others may use the term radome to include a cover plus attachment hardware, for discussion purposes, the term radome 110 as used herein may refer solely to the composite protective cover enclosing antenna 140 and might not include adapter plate 130 and mounting plate 120.

Adapter plate 130 contains multiple patterns of holes and multiple patterns of fasteners. These patterns of holes and patterns of fasteners may be placed in adapter plate 130 to accommodate a various models of antenna 140 available from manufacturers of antenna 140. Use of these patterns of holes and patterns of fasteners may allow aircraft manufacturers to maintain one or few models of adapter plate 130 in parts inventory. Use of these patterns of holes and patterns of fasteners may allow airlines and others replacing antenna 140 on aircraft in service to do so without fully removing radome 110 and associated attachment hardware from aircraft.

Figure 2:
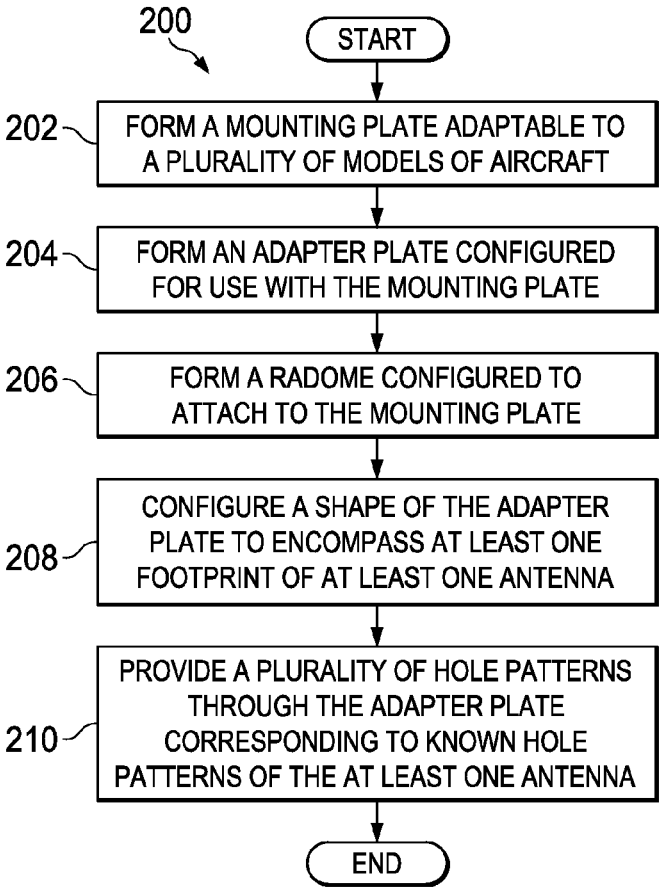
FIG. 2 is a flowchart of a method for building an aircraft antenna mounting system in accordance with an illustrative embodiment.

FIG. 2 is an illustration of a flowchart of a method for building an aircraft antenna mounting system in accordance with an illustrative embodiment. Method 200 shown in FIG. 2 may be a variation of the processes discussed in connection with FIG. 1 and with FIG. 3 through FIG. 8. Although the operations presented in FIG. 2 are described as being performed by "a process," the operations may be performed using one or more physical devices, as described elsewhere herein.

Method 200 may begin as the process forms a mounting plate adaptable to a plurality of models of aircraft (operation 202). The process may then form an adapter plate configured for use with the mounting plate (operation 204). The process may then form a radome configured to attach to the mounting plate (operation 206). The process may then configure a shape of the adapter plate to encompass at least one footprint of at least one antenna (operation 208). The process may then provide a plurality of hole patterns through the adapter plate corresponding to known hole patterns of the at least one antenna (operation 210).

The process shown in FIG. 2 is exemplary only. The process may be varied, both in terms of the number of operations as well as in terms of what devices are used to carry out the operations. For example, more or different the operations of method 200 may be executed in a different order than provided herein. Thus, the claimed inventions are not necessarily limited by the operations described in FIG. 2.

Figure 3:
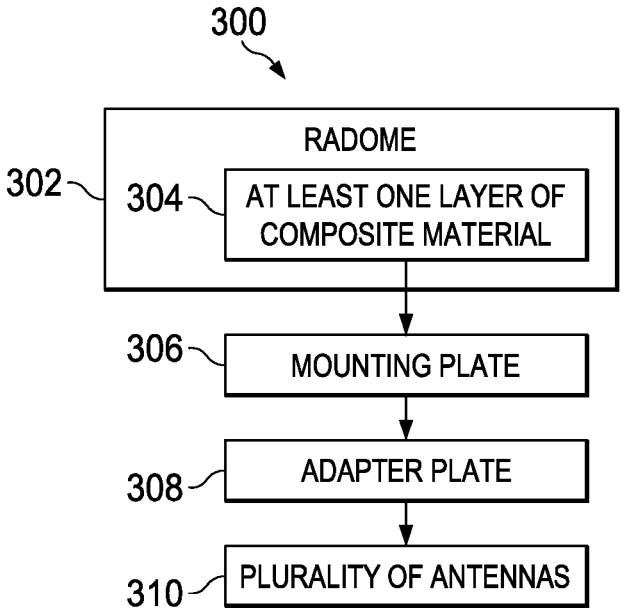
FIG. 3 is an illustration of a block diagram of an aircraft antenna mounting system in accordance with an illustrative embodiment.

FIG. 3 is an illustration of a block diagram of an aircraft antenna mounting system in accordance with an illustrative embodiment. FIG. 3 depicts components of system 100 including radome 110, mounting plate 120, adapter plate 130, and antenna 140 of FIG. 1.

Thus, the illustrative embodiments provide for antenna attachment apparatus 300. Antenna attachment apparatus 300 may include radome 302. Radome 302 may include at least one layer of composite material 304. Antenna attachment apparatus 300 may also include mounting plate 306 attached to radome 302. Antenna attachment apparatus 300 may also include adapter plate 308. Adapter plate 308 may be associated with mounting plate 306. Adapter plate 308 may be configured to fit plurality of antennas 310. Plurality of antennas 310 may be of different types such that, without the illustrative embodiments, at least some ones of the plurality of antennas 310 could not be attached to adapter plate 308.

As used herein, "associated with" means "attached directly to", "attached indirectly to", or "integral with." "Attached indirectly to" something means that some other intervening structure is between the two indirectly connected objects, with that intervening structure still attached to the overall structure.

In an illustrative embodiment, plurality of antennas 310 may be radio-frequency band antennas. In an illustrative embodiment, adapter plate 308 may be one of bonded to the mounting plate, welded to the mounting plate, fastened to the mounting plate, and comprising a single continuous component with the mounting plate.

In another illustrative embodiment, adapter plate 308 may be shaped and may include a plurality of holes and alignment features to accommodate attachment of the plurality of antennas. In this case, the plurality of holes may be arranged in fastener patterns. Still further, the plurality of attachment and alignment holes arranged in fastener patterns may accommodate a plurality of antenna models. In this further case, a first fastener pattern may accommodate at least a first model of antenna and a second fastener pattern accommodates at least a second model of antenna.

In another illustrative embodiment, adapter plate 308 may include a common antenna attach horizontal attach plane. In still another illustrative embodiment, adapter plate 308 may include access pockets promoting bonding and grounding and includes an electromagnetic interference design characteristic.

In yet another illustrative embodiment, a swept volume provides around a 0.50 inch clearance from an inside mold line of the radome. In still another illustrative embodiment, a universal antenna attachment apparatus may adapt to antennas transmitting signals using at least one of a Ka band and a Ku band. Other variations are possible; thus, the illustrative embodiments are not necessarily limited to the examples described with respect to FIG. 3.

Figure 4:
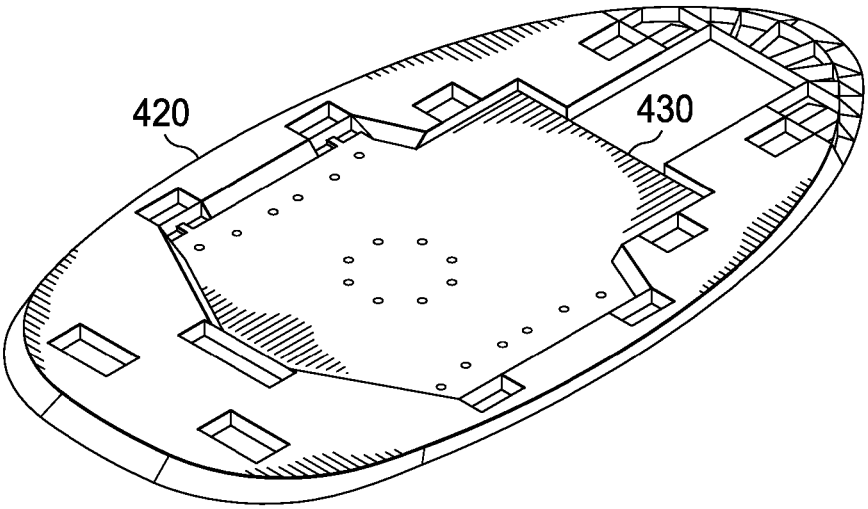
FIG. 4 is an illustration of an aircraft antenna mounting system in accordance with an illustrative embodiment.
Figure 5A:
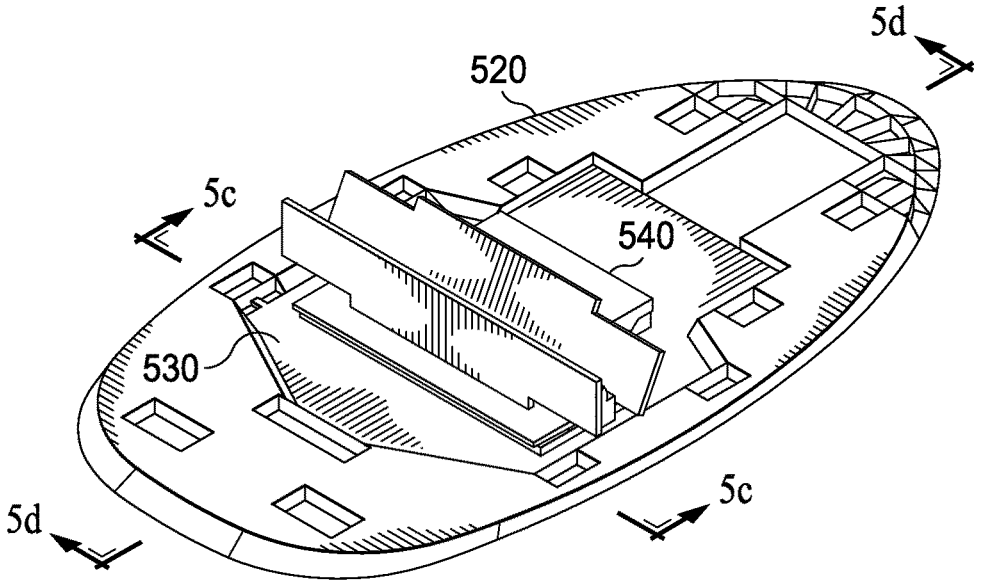
FIGS. 5*a*-5*e* are illustrations of block diagrams of an aircraft antenna mounting system in accordance with an illustrative embodiment.
Figure 5B:
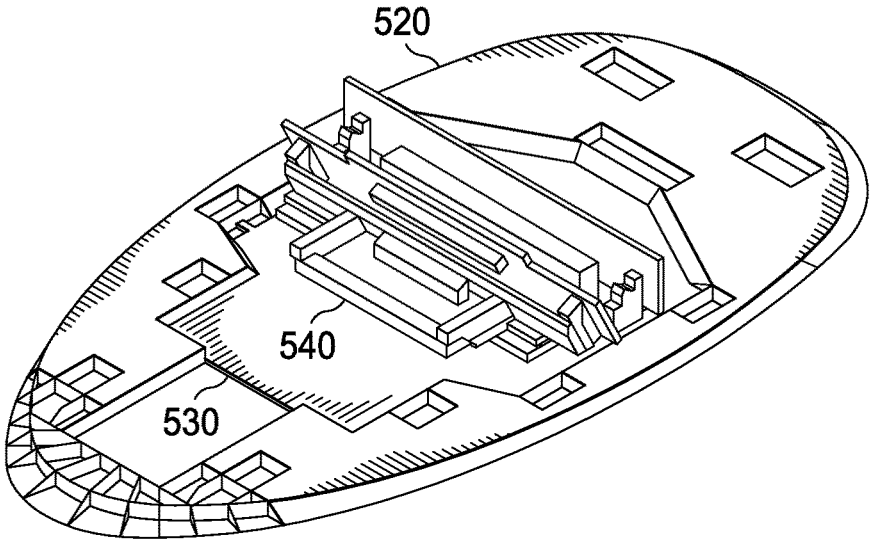
Figure 5C:
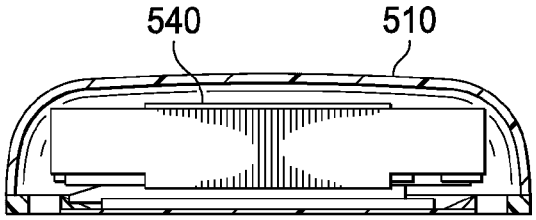
Figure 5D:
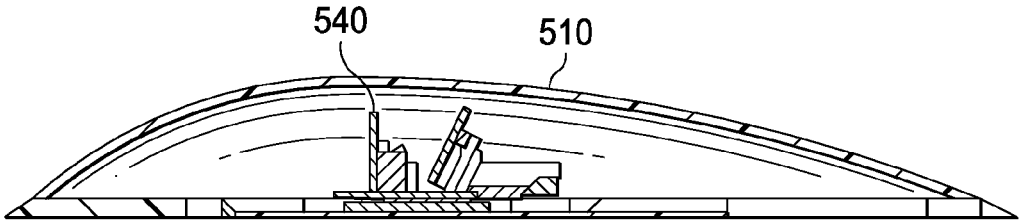
Figure 5E:
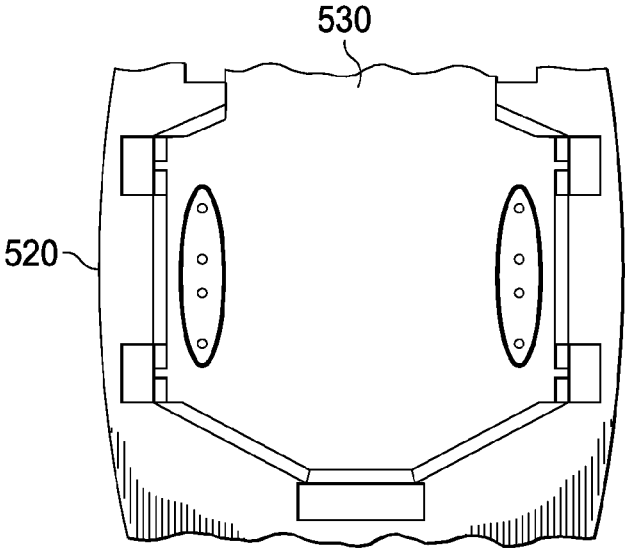
Figure 6A:
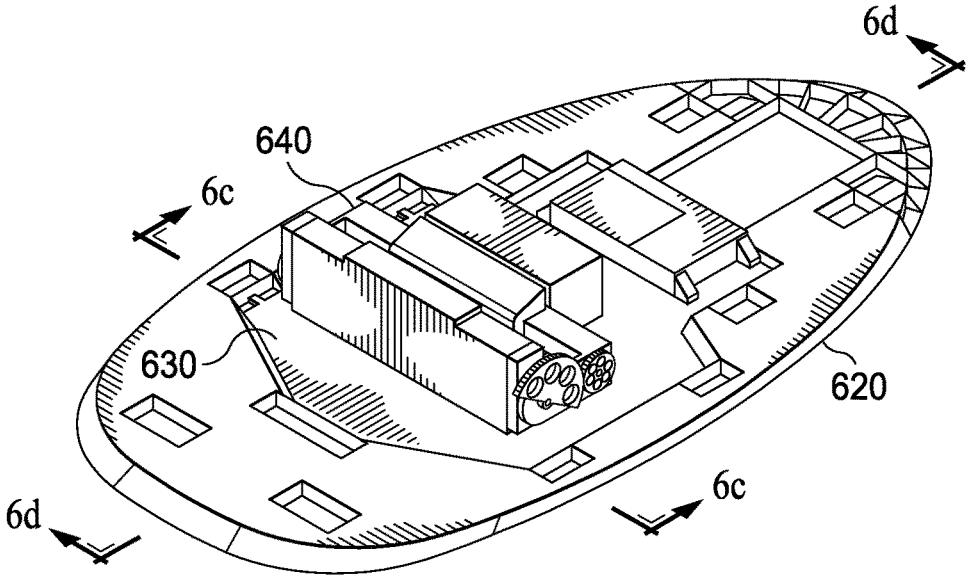
FIGS. 6*a*-6*e* are illustrations of block diagrams of an aircraft antenna mounting system in accordance with an illustrative embodiment.
Figure 6B:
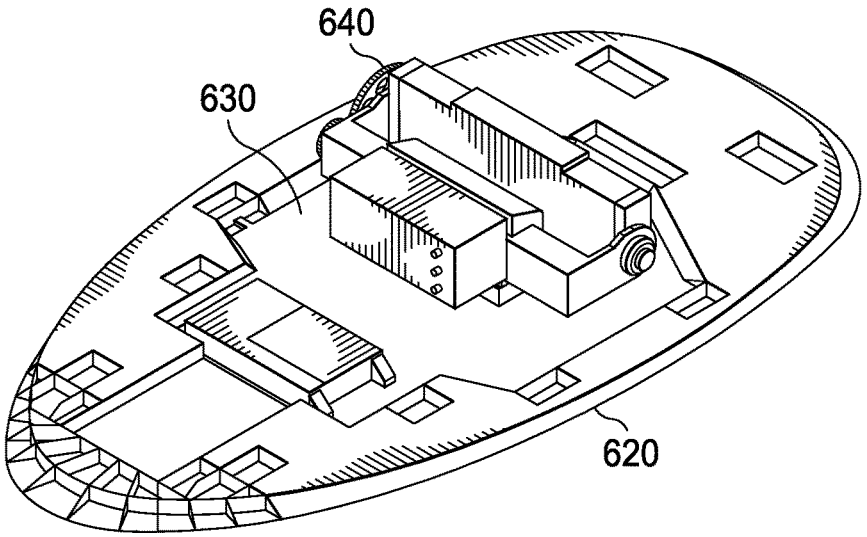
Figure 6C:
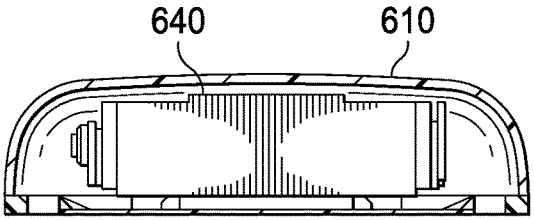
Figure 6D:
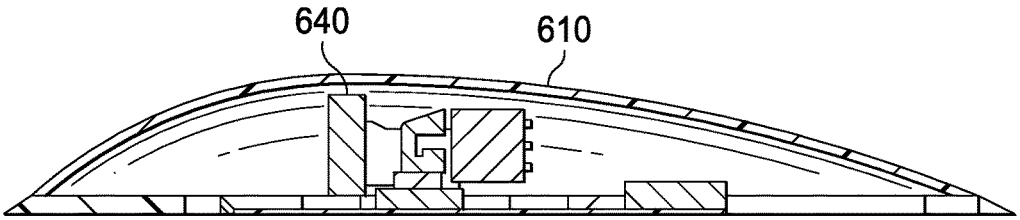
Figure 6E:
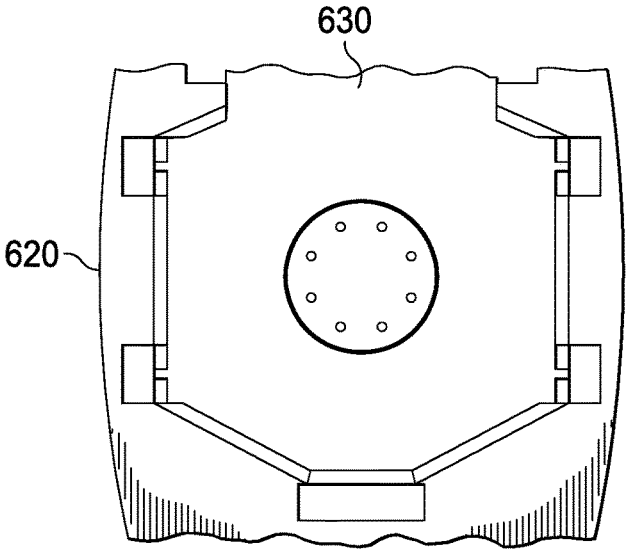
Figure 7A:
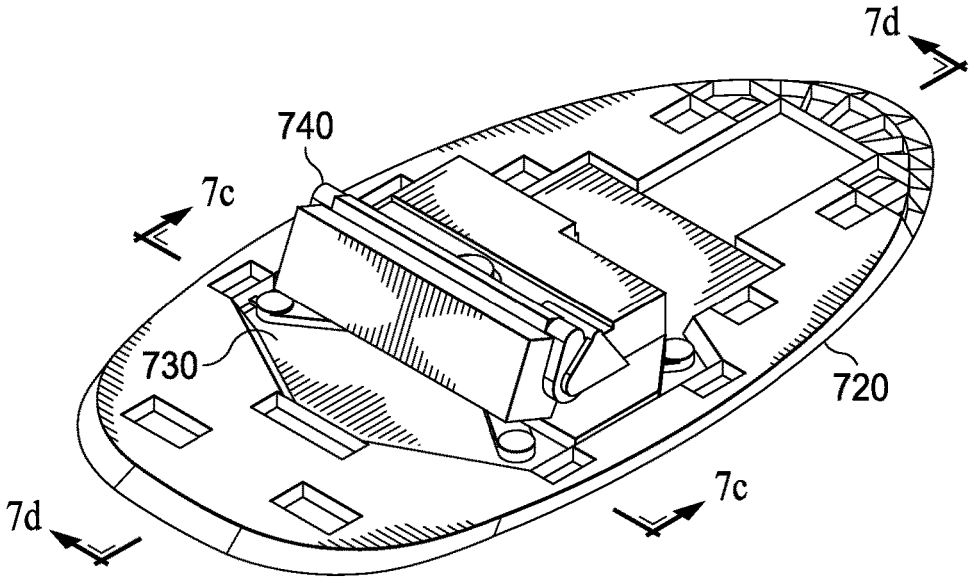
FIGS. 7*a*-7*e* are illustrations of block diagrams of an aircraft antenna mounting system in accordance with an illustrative embodiment.
Figure 7B:
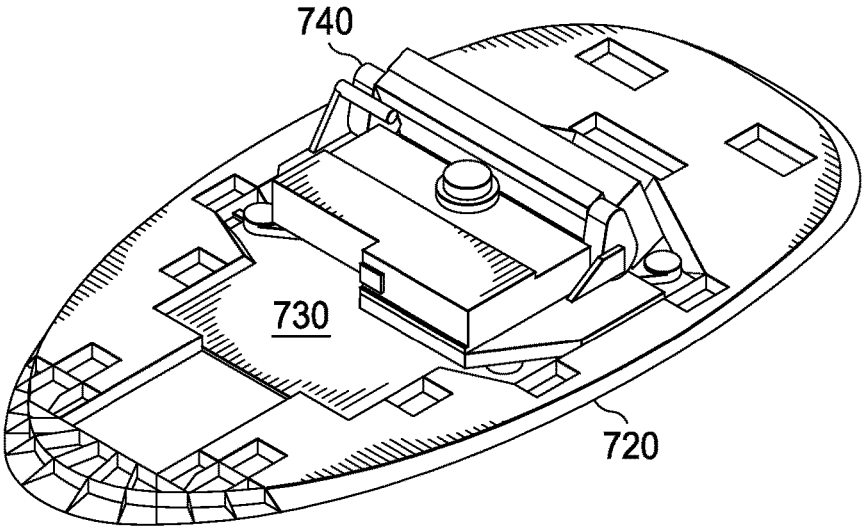
Figure 7C:
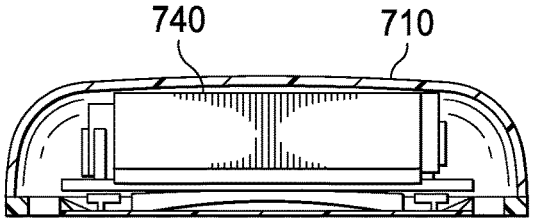
Figure 7D:
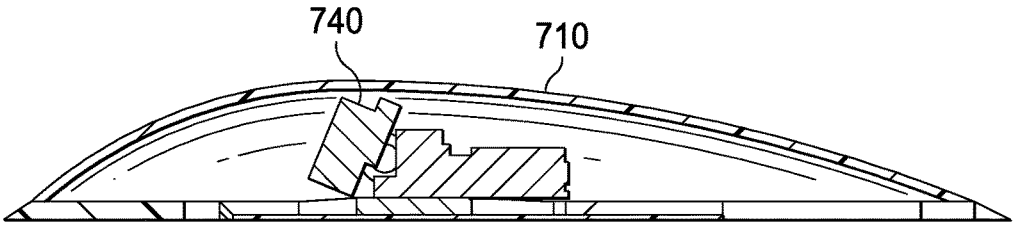
Figure 7E:
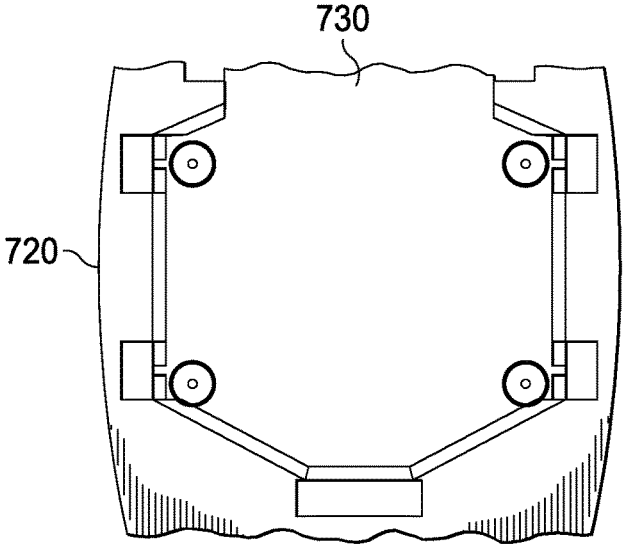
Figure 8A:
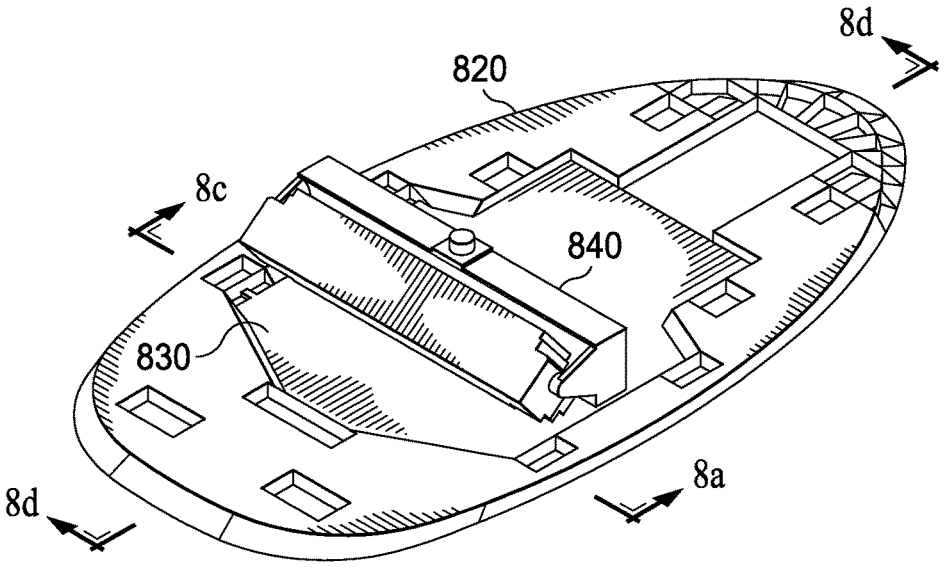
FIGS. 8*a*-8*e* are illustrations of block diagrams of an aircraft antenna mounting system in accordance with an illustrative embodiment.
Figure 8B:
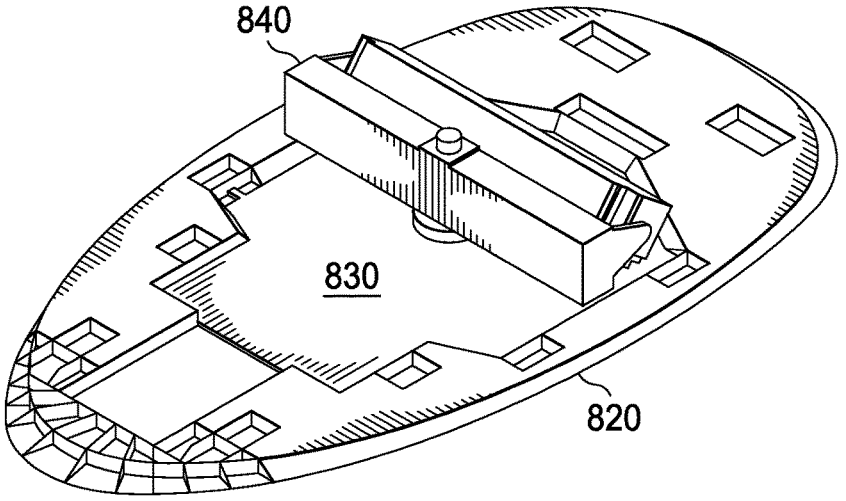
Figure 8C:
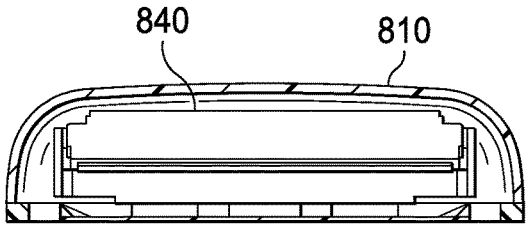
Figure 8D:
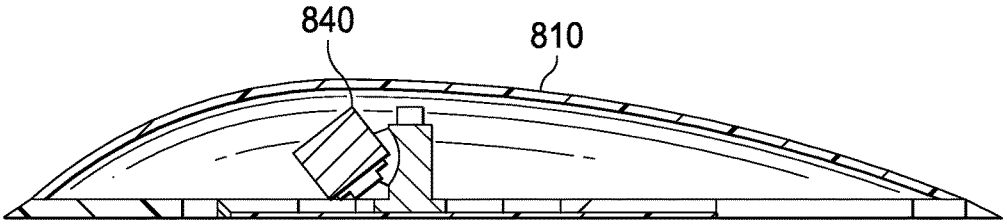
Figure 8E:
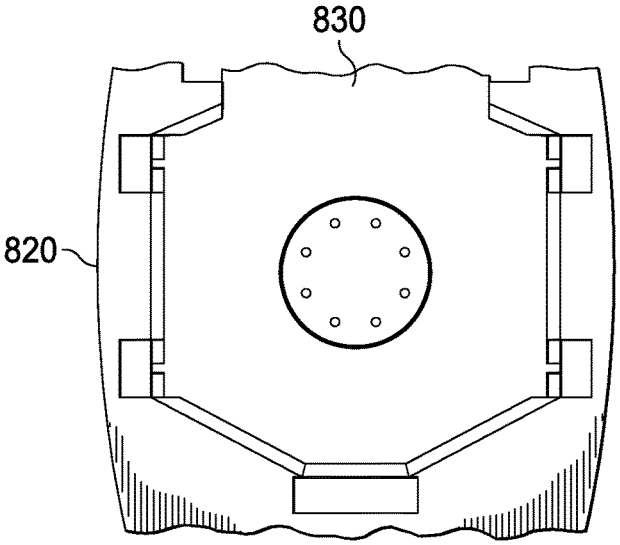

FIG. 4 is an illustration of an aircraft antenna mounting system in accordance with an illustrative embodiment. FIG. 4 depicts mounting plate 420 and adapter plate 430 in accordance with an illustrative embodiment. Components in FIG. 4 are indexed to components in FIG. 1. Adapter plate 430 may contain several patterns of holes that are used by various models of antenna 140 for attachment. A model of antenna 140 sold by a first manufacturer may attach to adapter plate 430 using the circle of holes in the middle of adapter plate 430. A model of antenna 140 sold by a second manufacturer may attach to adapter plate 430 using the pair of semicircular lines of holes along either side of adapter plate 430. Rectangular holes or slots visible in the components depicted in FIG. 4 are lugs used to attach mounting plate 420 to aircraft.

FIGS. 5*a*-5*e*, FIGS. 6*a*-6*e*, FIGS. 7*a*-7*e*, and FIGS. 8*a*-8*e* are illustrations of block diagrams of an aircraft antenna mounting system in accordance with illustrative embodiments. Each of FIGS. 5*a*-5*e*, FIGS. 6*a*-6*e*, FIGS. 7*a*-7*e*, and FIGS. 8*a*-8*e* depicts the components of system 100 in five similar views. FIGS. 5*a*-5*e*, FIGS. 6*a*-6*e*, FIGS. 7*a*-7*e*, and FIGS. 8*a*-8*e* depicts components of system 100 with a different model of antenna 140. Model of antenna 140 depicted in each of FIGS. 5*a*-5*e*, FIGS. 6*a*-6*e*, FIGS. 7*a*-7*e*, and FIGS. 8*a*-8*e* is specific to a currently well known vendor of antenna 140.

Each of FIG. 5, FIG. 6, FIG. 7, and FIG. 8 depicts five separate views of system 100, marked (a), (b), (c), (d), and (e). View (a) and view (b) in each of FIG. 5, FIG. 6, FIG. 7, and FIG. 8 is a top view of the components of system 100 except for radome 110 which is not pictured and would have been removed to make possible each of view (a) and view (b). In view (a) and view (b) of each of FIG. 5, FIG. 6, FIG. 7, and FIG. 8, a front and back view of antenna 140 is provided.

View (c) of each of FIG. 5, FIG. 6, FIG. 7, and FIG. 8 is a front or back view of the components of system 100 with view (c) including radome 100. View (d) of each of FIG. 5, FIG. 6, FIG. 7, and FIG. 8 is a side view of the components of system 100 with view (d) including radome 100. View (e) of each of FIG. 5, FIG. 6, FIG. 7, and FIG. 8 is a top view of mounting plate 120 and adapter plate 130 with circles drawn around each of the sets of holes used for attachment of the particular model of antenna depicted in each of the figures.

Antenna 540 depicted in FIG. 5 is available from a first vendor. Antenna 640 in FIG. 6 is available from a second vendor. Antenna 740 in FIG. 7 is available from a third vendor. Antenna 840 in FIG. 8 is available from a fourth vendor. In the illustrative embodiments described herein, the various vendors provide different antennas that require different types of mounting arrangements. Possible vendors include PANASONIC®, HONEYWELL®, TECOM INDUSTRIES, INC.®, VIASAT, INC.®, AEROSAT CORPORATION®, THINKOM SOLUTIONS, INC.®, and others.

FIG. 5 in view (a) and in view (b) depicts mounting plate 520, adapter plate 530, and antenna 540. FIG. 5 in view (c) and view (d) depicts radome 510 and antenna 540. FIG. 5 in view (e) depicts mounting plate 520 and adapter plate 530.

FIG. 6 in view (a) and in view (b) depicts mounting plate 620, adapter plate 630, and antenna 640. FIG. 6 in view (c) and view (d) depicts radome 610 and antenna 640. FIG. 6 in view (e) depicts mounting plate 620 and adapter plate 630.

FIG. 7 in view (a) and in view (b) depicts mounting plate 720, adapter plate 730, and antenna 740. FIG. 7 in view (c) and view (d) depicts radome 710 and antenna 740. FIG. 7 in view (e) depicts mounting plate 720 and adapter plate 730.

FIG. 8 in view (a) and in view (b) depicts mounting plate 820, adapter plate 830, and antenna 840. FIG. 8 in view (c) and view (d) depicts radome 810 and antenna 840. FIG. 8 in view (e) depicts mounting plate 820 and adapter plate 830.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An antenna attachment apparatus, comprising:

a mounting plate attached to a fuselage of an aircraft;

a radome attached to the mounting plate, the radome comprising a composite material;

an adapter plate attached to the mounting plate, the adapter plate having a plurality of different patterns of holes and fasteners, wherein ones of the plurality of different patterns of holes and fasteners are configured to fit corresponding ones of a plurality of different models of antennas, whereby the adapter plate allows the plurality of different models of antennas to be installed or uninstalled on the adapter plate without removing the mounting plate or the radome from fuselage of the aircraft.

2. The antenna attachment apparatus of claim 1, further comprising a plurality of antennas, from the plurality of different models of antennas, attached to the adapter plate, wherein the plurality of antennas comprise radio-frequency band antennas.

3. The antenna attachment apparatus of claim 1, wherein the adapter plate is one of bonded to the mounting plate, welded to the mounting plate, fastened to the mounting plate, and comprises a single continuous component with the mounting plate.

4. The antenna attachment apparatus of claim 1, wherein the adapter plate is shaped and further comprises alignment features to accommodate attachment of the plurality of different models of antennas.

5. The antenna attachment apparatus of claim 1, wherein a first fastener pattern accommodates at least a first model of antenna and a second fastener pattern accommodates at least a second model of antenna, the first model and the second model being different.

6. The antenna attachment apparatus of claim 1, wherein the adapter plate includes a common antenna attach horizontal attach plane.

7. The antenna attachment apparatus of claim 1, wherein the adapter plate includes access pockets promoting bonding and grounding and includes an electromagnetic interference design characteristic.

8. The antenna attachment apparatus of claim 1, wherein a swept volume provides around a 0.50 inch clearance from an inside mold line of the radome.

9. The antenna attachment apparatus of claim 1, wherein the plurality of different models of antennas include at least one of a Ka band antenna and at least one of a Ku band antenna.

10. A method comprising:

forming a mounting plate adaptable to a plurality of different models of aircraft;

forming an adapter plate configured for use with the mounting plate;

forming a radome configured to attach to the mounting plate;

configuring a shape of the adapter plate to encompass at least both of a first footprint of a first antenna and a second, different footprint of a second antenna; and providing a plurality of hole patterns through the adapter plate, wherein the plurality of hole patterns includes at least both of a first pattern that is configured to mount the first antenna and a second hole pattern that is configured to mount the second antenna.

11. The method of claim 10, further comprising forming the radome to clear a plurality of antenna sweep volumes.

12. The method of claim 10, further comprising aligning the hole patterns in the attachment plate to position a corresponding antenna sweep volume within a radome clearance volume.

13. The method of claim 10, wherein the adapter plate is one of bonded to the mounting plate, welded to the mounting plate, fastened to the mounting plate, and comprises a single continuous component with the mounting plate.

14. An aircraft comprising:

a fuselage configured for flight;

a mounting plate attached to the fuselage;

a radome attached to the mounting plate, the radome comprising a composite material;

an adapter plate attached to the mounting plate, the adapter plate having a plurality of different patterns of holes and fasteners, wherein ones of the plurality of different patterns of holes and fasteners are configured to fit corresponding ones of a plurality of different models of antennas, whereby the adapter plate allows the plurality of different models of antennas to be installed or uninstalled on the adapter plate without removing the mounting plate or the radome from fuselage of the aircraft.

15. The aircraft of claim 14, further comprising a plurality of antennas, from the plurality of different models of antennas, attached to the adapter plate, wherein the plurality of antennas comprise radio-frequency band antennas.

16. The aircraft of claim 14, wherein the adapter plate is one of bonded to the mounting plate, welded to the mounting plate, fastened to the mounting plate, and comprises a single continuous component with the mounting plate.

17. The aircraft of claim 14, wherein a first fastener pattern accommodates at least a first model of antenna and a second fastener pattern accommodates at least a second model of antenna, the first model and the second model being different.

18. The aircraft of claim 14, wherein the adapter plate includes one of a common antenna attach horizontal attach plane.

19. The aircraft of claim 14, wherein the adapter plate includes access pockets for bonding and grounding and includes an electromagnetic interference design characteristics.

20. A method of changing antennas installed on an aircraft having a mounting plate attached to a fuselage of the aircraft, a radome attached to the mounting plate, and an adapter plate attached to the mounting plate, the adapter plate having a plurality of different patterns of holes and fasteners, wherein ones of the plurality of different patterns of holes and fasteners are configured to fit corresponding ones of a plurality of different models of antennas, the method comprising:

detaching a first antenna from a first pattern of holes and fasteners in the adapter plate without removing the mounting plate or the radome from the fuselage of the aircraft; and attaching a second antenna to a second pattern of holes and fasteners in the adapter plate without removing the mounting plate or the radome from the fuselage of the aircraft, wherein the second antenna is a second model different than a first model of the first antenna, and wherein the first pattern is different than the second pattern.

* * * * *